US009508245B2

(12) United States Patent
Dunn

(10) Patent No.: US 9,508,245 B2
(45) **Date of Patent: *Nov. 29, 2016**

(54) SEWER ALARM APPARATUS WITH PROBE EXTENDING THROUGH A MONITORED PIPE

(71) Applicant: Tristram C. Dunn, Darien, CT (US)

(72) Inventor: Tristram C. Dunn, Darien, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/818,625

(22) Filed: Aug. 5, 2015

(65) Prior Publication Data

US 2015/0371526 A1 Dec. 24, 2015

Related U.S. Application Data

(63) Continuation of application No. 14/083,698, filed on Nov. 19, 2013, now Pat. No. 9,127,445.

(51) Int. Cl.

| | |
|---|---|
| ***G08B 21/00*** | (2006.01) |
| ***G08B 21/20*** | (2006.01) |
| ***E03F 7/00*** | (2006.01) |
| ***E03F 5/042*** | (2006.01) |

(52) U.S. Cl.

CPC ..... *G08B 21/20* (2013.01); *E03F 5/042* (2013.01); *E03F 7/00* (2013.01); *E03F 2201/40* (2013.01)

(58) Field of Classification Search

CPC ..... E03F 7/00; E03F 2201/40
USPC ..... 340/606, 608, 616; 73/290 R, 304 R, 73/304 C; 137/558, 559
See application file for complete search history.

(56) References Cited

U.S. PATENT DOCUMENTS 5,113,901 A * 5/1992 Young ..... E03F 7/00 137/554

* cited by examiner

*Primary Examiner* — Jeffrey Hofsass
(74) *Attorney, Agent, or Firm* — Buckley, Maschoff & Talwalkar LLC

(57) ABSTRACT

According to some embodiments, sewer alarm devices and apparatus are provided for detecting the presence of liquid within a pipe. In some embodiments, the devices and apparatus include a housing defining an interior volume, the housing including a top portion and a bottom portion, the bottom portion mounted on an exterior surface of the pipe. At least a first mounting portion extends outwardly from the housing and receives at least a first strap securing the housing to the exterior surface of the pipe. A probe housing extends from the interior volume of the housing to an interior of the pipe, and at least a first probe is disposed within the probe housing and exposed to the interior of the pipe along a first direction substantially along a center axis of the pipe.

14 Claims, 11 Drawing Sheets

SEWER ALARM APPARATUS WITH PROBE EXTENDING THROUGH A MONITORED PIPE

CROSS REFERENCE TO RELATED APPLICATION

This is a continuation of, and claims benefit of and priority to, co-pending prior U.S. patent application Ser. No. 14/083,698, filed Nov. 19, 2013, the contents of which are hereby incorporated by reference in their entirety for all purpose.

FIELD OF THE INVENTION

The present disclosure relates to alarm systems. More particularly, embodiments relate to warning or alarm systems for alerting users of the undesirable presence of liquid (such as sewage) in a line (such as a sewer line or pipe).

BACKGROUND

Homes, offices and other buildings have one or more systems of pipes that are configured to channel wastewater from the building to a sewer system or septic tank. In a common configuration, one or more toilets, sinks, bathtubs, and showers may be connected to a main waste line which is connected to a drain line or lateral that is then connected to a septic system or to a public sewer line. The lateral or drain line may have one or more cleanout valves that allow maintenance access to the lateral or drain line.

Unfortunately, the drain line or lateral may become clogged or backed up. For example, in systems where a drain line or lateral (or portions thereof, such as the portions exterior to a foundation of a building) is formed of terracotta or clay pipe, the line is susceptible to cracking, separation, disturbance or blocking due to tree roots, soil shifting or settling, or the like. A drain line or lateral may also become clogged or blocked when certain items (such as tampons) are flushed down a toilet. When a drain line or lateral (or portion thereof) becomes clogged, cracked or otherwise blocked, the sewage or wastewater that should drain out to the septic system or sewer system backs up into the house or building. Often, the clog may cause a backup and then wastewater may overflow into the building from its nearest open low point. Such overflows or backups can be unpleasant, unhealthy and expensive to repair. Further, many sewer system backups are not covered under a typical homeowner's insurance policy, nor are they covered by flood insurance.

It would be desirable to provide an alarm system that alerts or warns a homeowner (or other individual or entity) of the undesirable or unexpected pending presence of fluid in a pipe such as an upper lateral pipe or other outflow pipe. Several potential solutions have been proposed. For example, in U.S. Pat. No. 4,973,950, a sewer blockage alarm is described which utilizes a pressure sensor switch mounted to the inside of a cap for a sewer clean out branch. U.S. Pat. No. 7,907,059 describes a similar alarm that is mounted in a cap of a pipe. Unfortunately, each of these systems requires that an alarm apparatus be mounted in a cap of a pipe (which assumes the building occupant or owner have access to a drain or clean out cap). Further, the inventor of the present invention has determined that placement of an alarm sensor device in a drain or cleaning pipe does not allow a pipe blockage to be detected sufficiently early enough to be corrected—instead, when a blockage is severe enough that wastewater is backing up to the cleaning pipe, a drain or other exit point (such as a toilet or the like), it is commonly too late for proactive maintenance action.

Canadian Patent No. 890926 (application number 1,261,940) describes a water backup alarm system which fits within a vertical pipe that leads to a sewer or septic system. The system is constructed of plastic material that fits entirely within a pipe. Unfortunately, installation of the system requires access to the interior of a pipe (such as, for example, through a cap or the like). Unfortunately, the system effectively reduces the interior dimensions of the pipe (which may result in blockage or obstruction of the pipe or a reduction in the capacity of the pipe). Further, the system requires that a user be able to access a section of pipe with a removable cap. Many homes or other buildings do not have drain systems with ready access to a suitable cap or section of pipe with a cap.

Accordingly, it would be desirable to provide a sewer alarm system which does not require access to or removal of a cap or other plug or endpoint of a pipe or drain line. Further, it would be desirable to provide a sewer alarm system that is easily mounted or fitted on an existing drain line or lateral. Further still, it would be desirable to provide a sewer alarm system which does not substantially block or impair the flow of wastewater through the drain line or lateral.

DETAILED DESCRIPTION

Embodiments relate to alarm systems that are usable to detect the undesired presence of fluid in a pipe system. In some embodiments, alarm systems are provided to detect the undesired presence of wastewater in a sewage system.

A number of terms are used herein for convenience and ease of exposition. For example, the term "sewage system" will be used to refer to waste drainage systems, including septic and sewer systems. The term "drain line" is used to refer to a pipe, system of pipes, or other connectors that deliver wastewater from out of a building to a sewage system. A drain line may be a plastic (PVC or the like), metal, clay or other material. Embodiments may be used in both commercial and residential applications.

Figure 1:
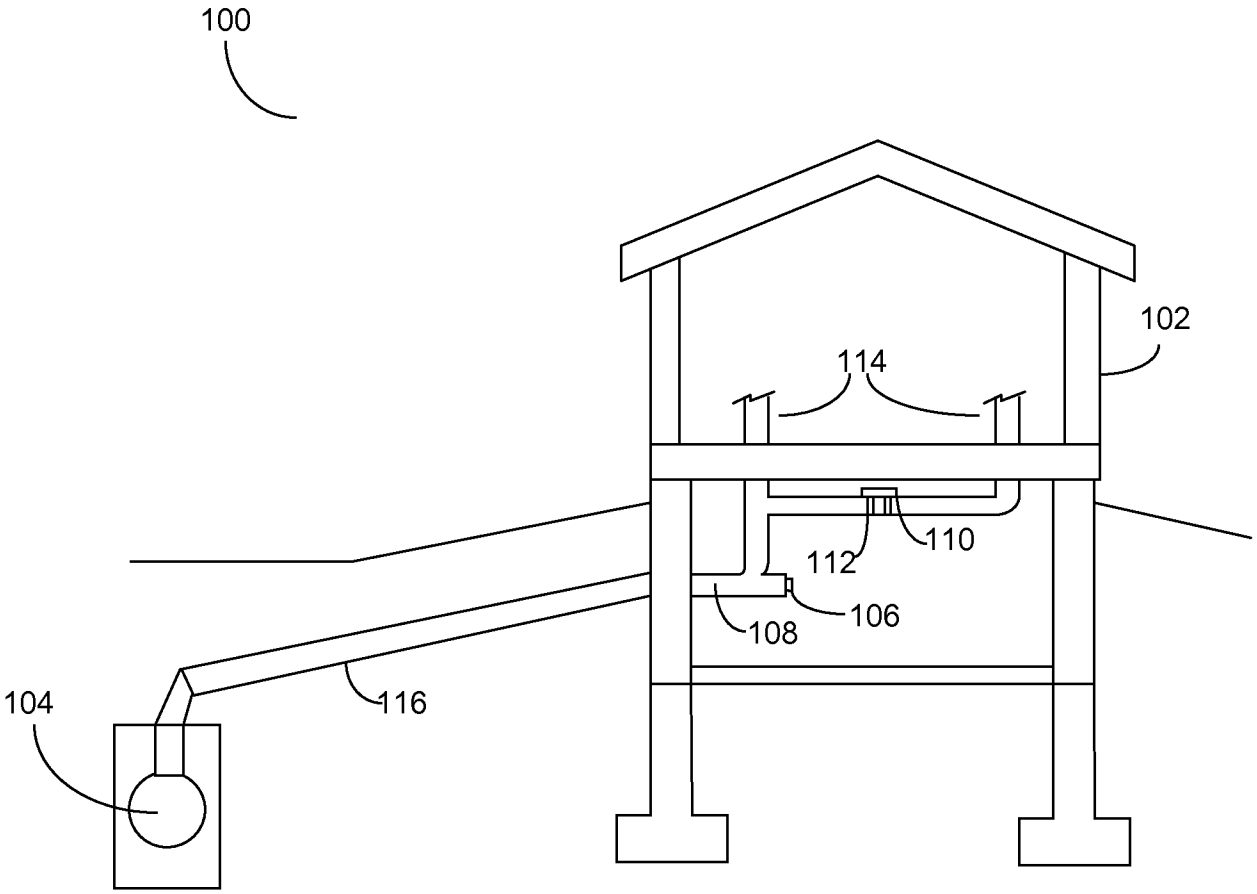
FIG. 1 is a sectional view of a building and sewer line having a sewer alarm according to some embodiments.

Features of some embodiments will now be described by reference to the drawings. Reference is first made to FIG. 1, where a sectional view of a building 102 is shown in which a sewer alarm system 110 pursuant to some embodiments has been installed. In the embodiment shown in FIG. 1, a building 102 is connected to a sewer line 104 via a section of underground pipe referred to herein as a lateral 116 and a second section referred to herein as drain line 108. Often, the drain line 108 exits the building through a point in the foundation of the building 102. Pursuant to some embodiments, the sewer alarm system 110 of the present invention may be located near the point where the drain line 108 exits the building 102 (as that point is the lowest point of the drain line 108 and provides a desirable location for identifying the presence of undesired wastewater). The drain line 108 may be connected to one or more other drain pipe systems 114 from within the building 102 (for example, the drain systems 114 may be connected to toilets, dishwashers, sinks, or other devices in the building 102). While only two drains 114 are shown, in a typical building multiple drain lines may feed into the drain line 108. One drain line 108 is shown in FIG. 1, although those skilled in the art will appreciate that a building 102 may have more than one drain line to deliver wastewater to the lateral 116 for eventual delivery to a sewer or septic system. Although not shown in FIG. 1, the drain lines 114 may be connected to devices such as dishwashers, toilets, showers, bathtubs, or the like within the building 102.

The drain line 108 exits the building (e.g., through a via in the foundation) and may have a cap or cleanout 106 which may, in some situations, be removed to allow cleaning materials from the drain line 108 or other access to the drain line 108 or the lateral 116. Pursuant to some embodiments, a sewer alarm system 110 may be mounted on an exterior surface of the drain line 108 (or other line in the building 102) using a mounting system 112. In some embodiments, the sewer alarm system 110 is positioned on a portion of a drain line 108 or other pipe in the building that is in communication with a lateral 116 or other pipe system that delivers wastewater to a sewer or septic system. In some embodiments, the sewer alarm system 110 is positioned on an existing exterior surface of a pipe or drain line that is substantially horizontal such that the alarm system 110 may detect the presence of undesired wastewater or fluid caused by a blocked or damaged pipe downstream from the area where the sewer alarm system 110 is mounted. In some embodiments, the sewer alarm system 110 may be positioned on an exterior surface of a pipe or drain line that is vertical or that otherwise provides a position allowing the sewer alarm system 110 to detect the presence of undesired wastewater or fluid caused by a blocked or damaged pipe downstream from the area where the system 110 is positioned. In some buildings, multiple sewer alarm systems 110 may be used to ensure early detection of blocked or clogged lines. Preferably, the sewer alarm system 110 is mounted on a pipe or drain line that is at or near a low exit point from the building 102. As shown in FIG. 1, the sewer alarm system 110 is shown as being positioned horizontally, however the system 110 may be positioned vertically or in a semi-vertical or semi-horizontal position. In general, the system 110 is desirably mounted near the low point of the drain line near the point where the drain line 108 exits the foundation of the building 102.

For example, in the system depicted in FIG. 1, the alarm system 110 is positioned in the basement of the building 102 near the egress of the drain pipe 108 through the foundation to the lateral pipe or line 116. This position may provide desirable results with the alarm system 110 of the present invention as it allows relatively early detection of a potential blockage of the lateral 116 or drain pipe 108. Further aspects of the positioning and installation of the alarm system 110 of the present invention will be described further herein by reference to the drawings that follow.

Sewer and other drain systems (such as shown in FIG. 1) commonly suffer from clogged, blocked or broken pipes or drain lines which can cause wastewater to back up into a building. When such a system backs up, the wastewater can enter the building through one or more open drain pipes or fixtures, causing significant damage to the building as well as inconvenience to the occupants and the potential to spread undesirable mold and disease. Many older sewer and septic lines are constructed of clay or other pipes that are susceptible to root invasion from plants and trees. For example, tree roots thrive on the moisture and bacteria from a sewer line, and are often able to penetrate a pipe. As the root grows, it can snag waste and cause a backup or clog that can only be corrected by attempting to use a snake or other tool to clean or clear an interior of the pipe or by digging the pipe up. Further, many buildings have septic systems. These systems fail after a period of use (up to 2-3% of homes with septic tanks experience a failure each year). The sewer alarm system 110 of the present invention may be used to provide a warning of a potential failure as the backup of wastewater often precedes or is associated with a septic tank failure.

It is desirable to detect such backups or clogs early, before damage to the property occurs. Embodiments of the present invention provide a convenient and accurate way to provide early detection of the presence of such backups. As will be described further herein by reference to the drawings, embodiments provide a sewer alarm system that can be easily mounted on an existing pipe (such as a drain pipe 108 or the like) without need to retrofit the pipe or cap 106. As a result, homeowners or maintenance personnel can easily install the sewer alarm system 110 of the present invention.

Figure 2:
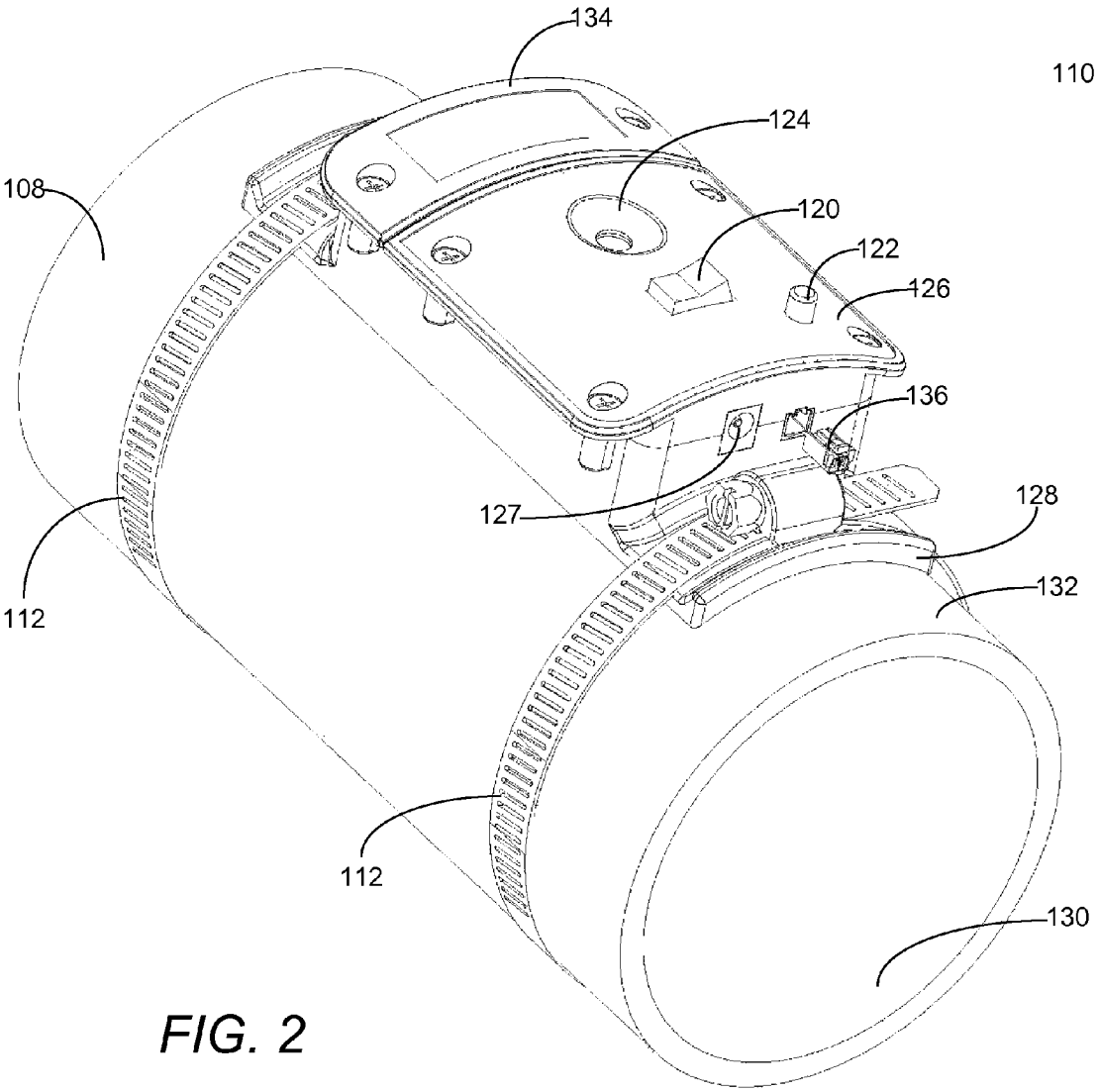
FIG. 2 is a side elevational view of a sewer alarm system according to some embodiments.

Reference is now made to FIG. 2, where a side elevational view of a sewer alarm system 110 installed on a pipe 108 is shown according to some embodiments. For example, the pipe 108 may be a drain or discharge pipe from a building such as the building 102 of FIG. 1. As shown, in some embodiments, a sewer alarm system 110 is mounted on an exterior surface 132 of a pipe 108. In some embodiments, the sewer alarm system 110 may be mounted to the exterior surface 132 using one or more straps 112. For example, the straps 112 may be O-ring clamps or other devices that allow a shaped or contoured housing 128 of the sewer alarm system 110 to be securely mounted to the pipe 108. In some embodiments, the shaped housing 128 of the sewer alarm system 110 includes a mounting portion at each end of the shaped housing 128 across which the straps 112 are positioned. In some embodiments, the shaped housing 128 is formed of a polyvinyl material or other shaped or molded material. The shaped housing 128 and the overall dimensions of the sewer alarm system 110 may be sized to match the type and/or size of pipe on which they are mounted. For example, in embodiments where the sewer alarm system 110 is to be used to detect potential blockages in a 4" diameter pipe, the shaped housing 128 may be approximately 6-7" long and 2.5" wide (although a wide variety of different sizes and shapes may be used, so long as the housing is sized to enclose the electronics and the housing is shaped to fit the exterior of the pipe). In general, the shaped housing 128 should be formed such that it may have a bottom surface (the surface in contact with the exterior 132 of the pipe 108) that generally matches the curvature of the pipe 108, thereby providing a more secure mount and coupling between the shaped housing 128 and the pipe 108. Although not shown in FIG. 2, in some embodiments, a gasket may be positioned between the shaped housing 128 and the exterior surface 132 of the pipe 108. For example, in some embodiments, the gasket may be formed of foam or rubber, providing a water tight seal between the pipe 108 and the shaped housing 128. The use of a gasket may also provide other desirable benefits. For example, the use of a gasket can allow a homeowner or other installer to tighten the shaped housing 128 onto the pipe 108 in a manner which doesn't harm the pipe 108 or the housing 128 and which assures the installer that the housing is tightly mounted onto the pipe 108.

In some embodiments, the shaped housing 128 of the sewer alarm system 110 includes one or more covers such as an electronics cover 126 and a battery cover 134. Each or all of the covers may be removably attached to the shaped housing 128 (e.g., using recessed screw mounts or the like), allowing access to the battery (in the case of the battery cover 134) and the electronics and speaker (in the case of the electronics cover). While two separate covers are shown in the embodiment illustrated in FIG. 2, any number of covers may be used to provide convenient access to some or all of the components of the sewer alarm system 108.

In some embodiments, the sewer alarm system 108 includes one or more switches 120, 122 as well as a speaker 124. As will be described further below, the switches 120, 122 allow the sewer alarm system 108 to be activated or deactivated (e.g., using switch 120) and tested (e.g., using switch 122). The speaker 124 is selected to provide an audible alert when the presence of backed up wastewater is detected by the sewer alarm system 108. While a speaker may be used, in some embodiments, as will be described further below, other alerting devices may also be used (such as, for example, lights, WiFi or cellular signals, or the like). For example, in some embodiments, the sewer alarm system 108 may placed in communication with an existing home alarm system such that a notice or other alert may be issued through the home alarm system when the presence of backed up wastewater is detected. In some embodiments, an external power source (as described below in conjunction with FIG. 10) may be coupled to the alarm using a jack 127. An external alarm (as described below in conjunction with FIG. 10) may be coupled to the alarm system 110 using a alarm connector 136.

Figure 3:
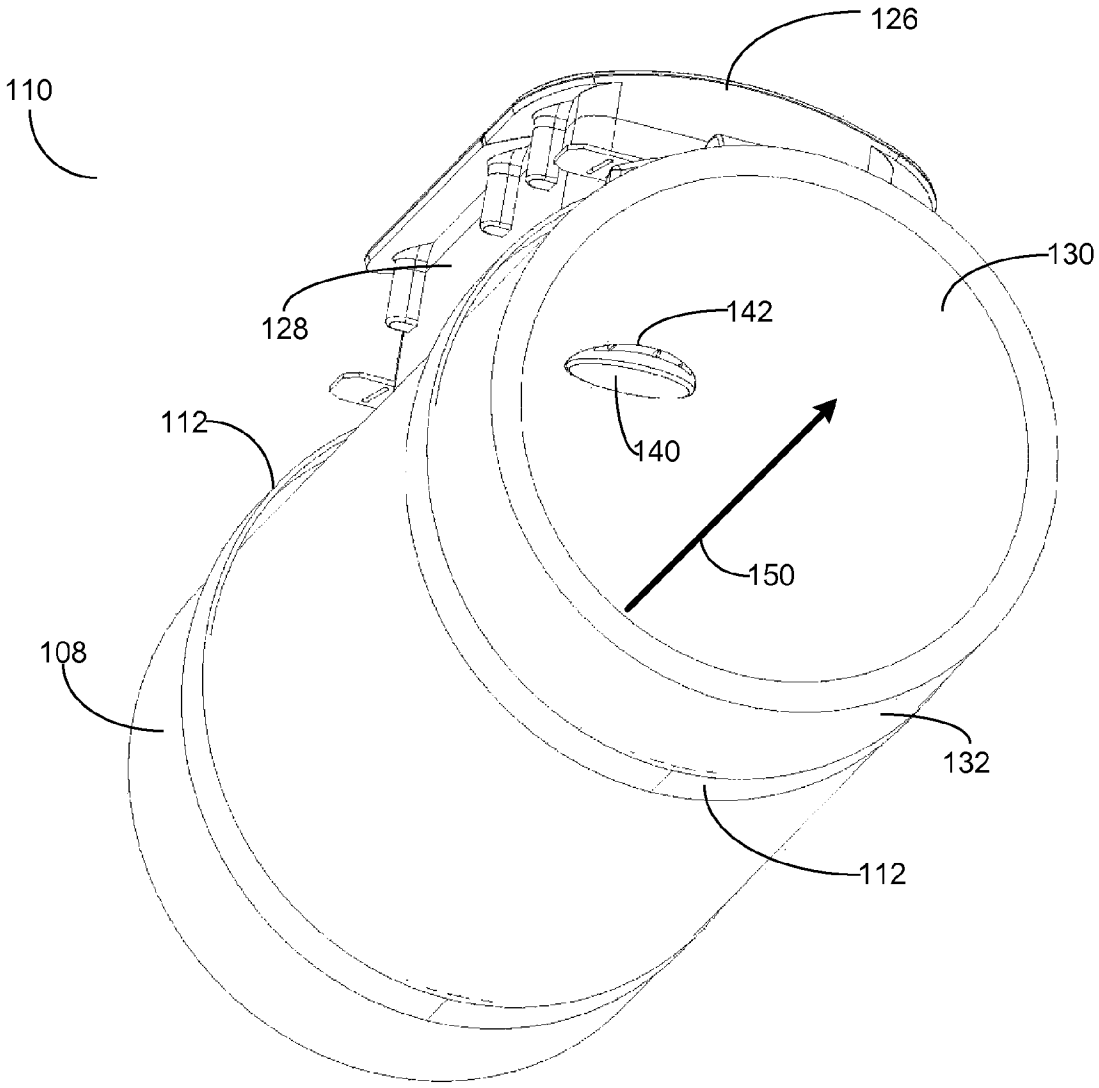
FIG. 3 is a further side elevational view of a sewer alarm system according to some embodiments.

Reference is now made to FIG. 3, where a further side elevational view of the sewer alarm system 110 installed on a pipe 108 is shown according to some embodiments. In the view shown in FIG. 3, the interior of the pipe 108 is shown in more detail, including details of the interior surface 130 of the pipe 108. As shown, the shaped housing 128 of the sewer alarm system 110 is mounted on the exterior surface 132 of the pipe 108 and has a probe housing 140 that extends through the pipe 108 into the interior of the pipe. The probe housing 140 has a sloped or angled surface that is positioned such that the normal flow of wastewater through the pipe 108 flows across the sloped or angled surface of the probe housing 140. For example, assuming the normal flow of wastewater through pipe 108 is indicated by the direction of arrow 150. The probe housing 140 houses one or more probe elements 142 which are protected from detecting the presence of wastewater during normal flows (i.e., when wastewater is flowing lower in the pipe, such as in the direction of arrow 150). However, when the pipe (or downstream pipes such as a lateral) becomes blocked, and wastewater collects or accumulates near the probe housing 140, the probe elements 142 are operated to trigger operation of the sewer alarm system 110 (e.g., to cause an alarm to sound, thereby alerting a home occupant or other entity of the possible blockage of the pipe system, as described below, the alarm that sounds may be an external alarm such as a home alarm system or it may be the alarm device mounted within the alarm system 110).

Figure 4:
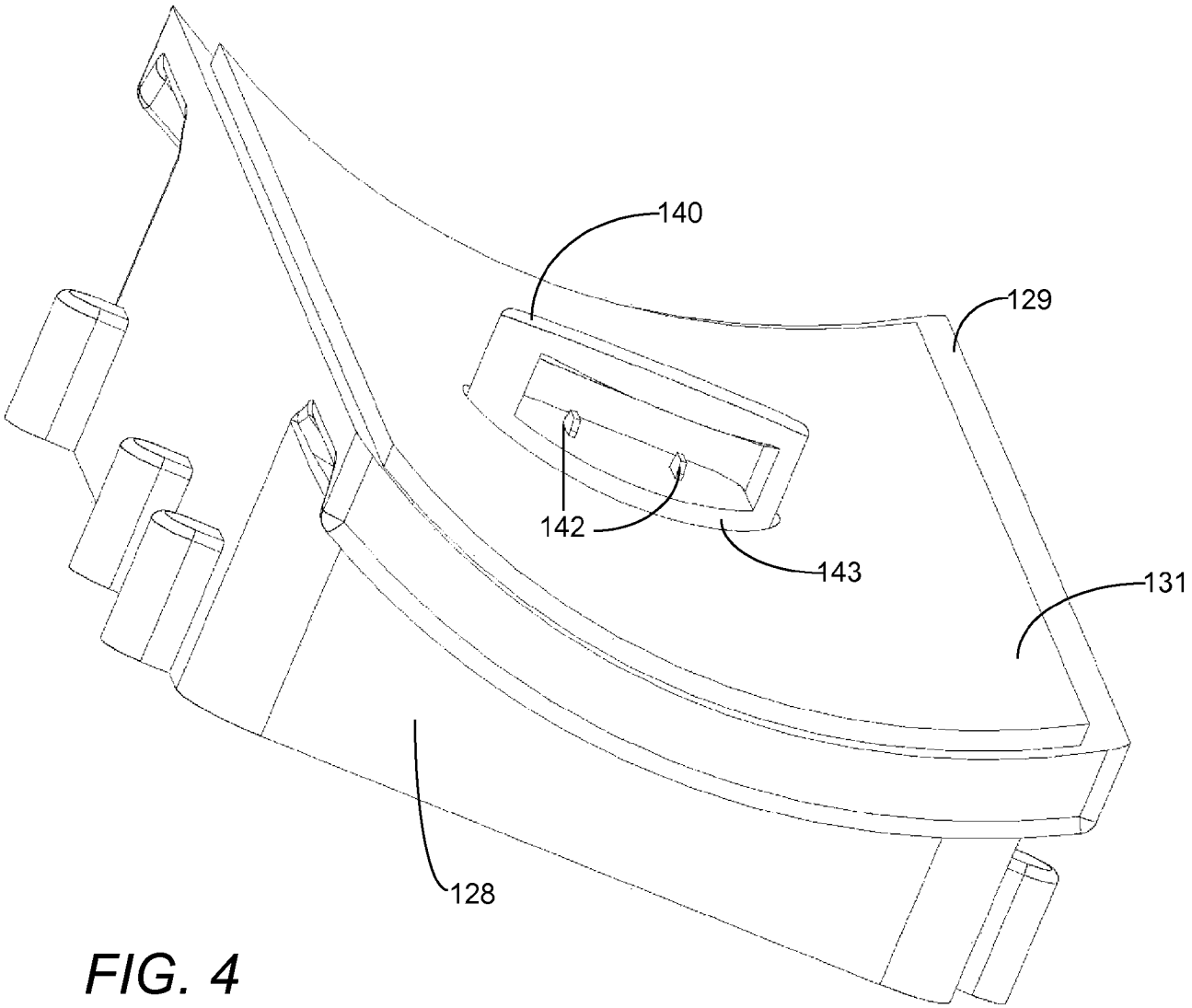
FIG. 4 is a partial side view of a portion of the sewer alarm system according to some embodiments.

Further details of some embodiments of the probe housing 140 and shaped housing 128 of the sewer alarm system 110 are shown in FIG. 4. FIG. 4 is a view of a bottom surface 129 of the shaped housing 128 (where the bottom surface 129 is the surface that mounts on the exterior surface 132 of the pipe). As shown the bottom surface 129 is shaped to substantially match the outer dimensions of a pipe to allow a secure mounting surface. In some embodiments, such as that shown in FIG. 4, a gasket 131 is positioned between the bottom surface 129 and the outer surface of a pipe (not shown in FIG. 4). The probe housing 140 extends from the body of the shaped housing 128 from the bottom surface 129. For example, the probe housing 140 may be sized such that the probe elements 142 are exposed to an interior volume of a pipe 108 when the sewer alarm system 110 is mounted on the pipe 108. For example, in the case where the pipe 108 has an exterior wall thickness of one-quarter inch (¼"), the probe elements 142 are positioned such that they extend (via a lip 143) more than ¼" from the bottom surface 129 of the shaped housing 128 (that is, lip 143 may be more than ¼" deep). This allows the probe elements 142 to be positioned such that they may be exposed to wastewater at the top of the wastepipe in the event of a backup. In some embodiments, the lip 143 may be longer (such as, for example, an inch in length), causing the probe housing to extend deeper within the interior of the pipe 108. In some embodiments, such an extension may reduce false alarms or other issues which may be result if the probe elements are too near an interior surface of the pipe 108.

The top surface 141 of the probe housing is shaped to form a recess protecting the probe elements 142 to prevent wastewater flowing downstream along the direction of arrow 150 from triggering an alarm. The probe housing may be formed of a smooth or other shape designed to reduce the chance of snagging waste as it travels downstream.

Figure 5:
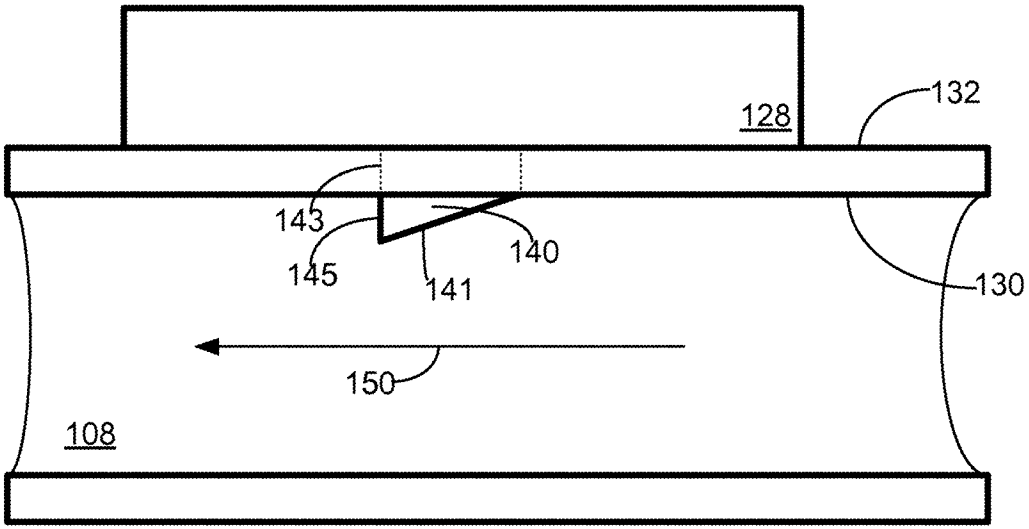
FIG. 5 is a partial side view of a portion of a pipe and the sewer alarm system according to some embodiments.

Further details of the probe housing 140 pursuant to some embodiments are shown in FIG. 5. In FIG. 5, a section of a pipe 108 is shown in cross-section, with an alarm system mounted thereon. The shaped housing 128 of the alarm system is shown as mounted on an exterior surface 132 of the pipe 108, and the probe housing 140 is shown as extending through a wall of the pipe 108 into the interior surface 130. More particularly, the probe housing 140 is shown as generally triangular in cross section, with the lower edge of the triangle facing the direction from where wastewater typically comes (traveling in the direction of arrow 150 to the sewer system). The top surface 141 of the probe housing 140 generally directs wastewater away from the probes (which are housed and exposed in the area shown as 145). As shown, a lip 143 is sized such that it extends the main portion of the probe housing through the wall of the pipe 108. The probe housing 140 may be shaped such that it has rounded edges to reduce the chance of unintentional snagging of waste as it travels downstream through the pipe 108.

Figure 11:
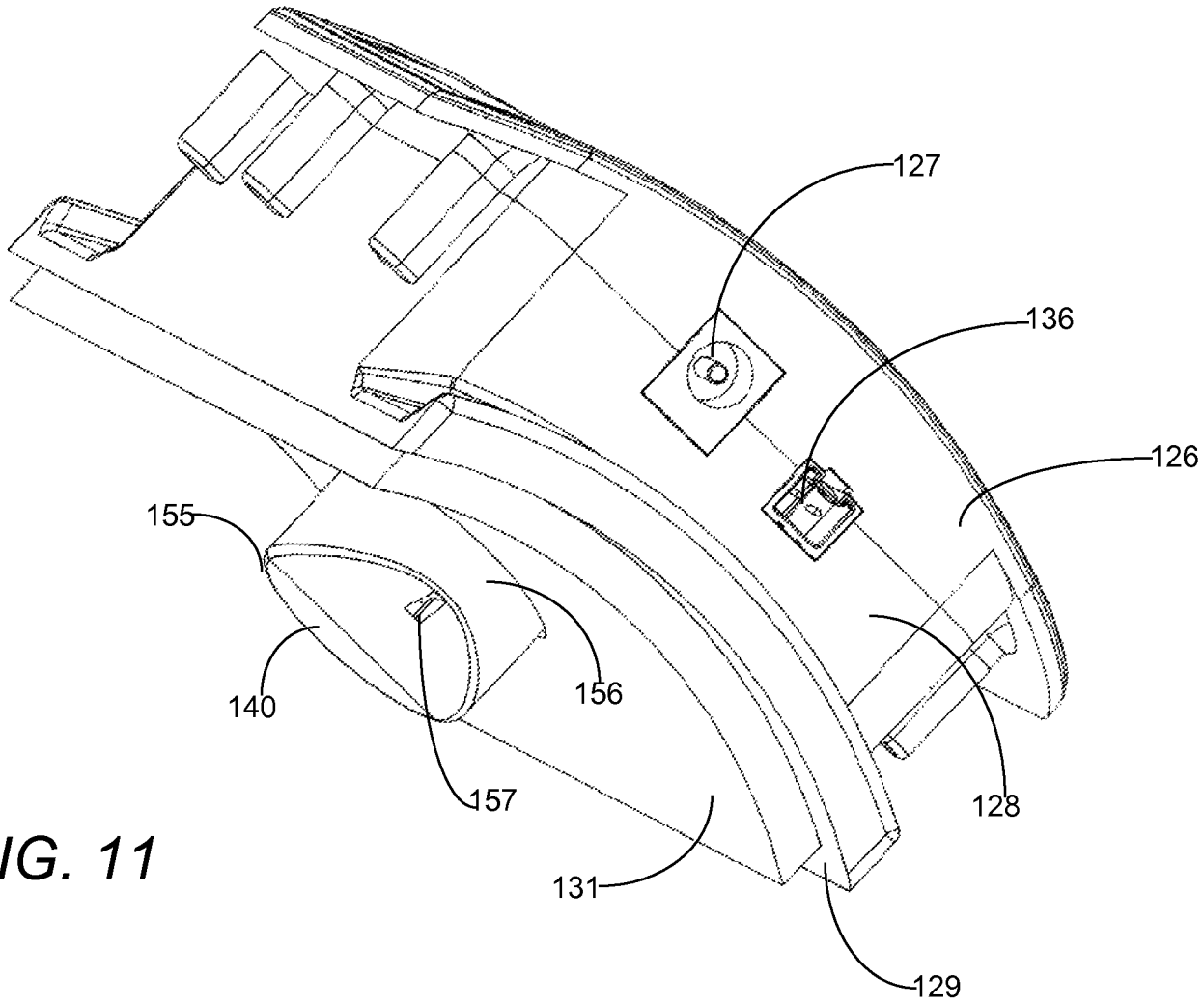
FIG. 11 is a further view of a portion of the sewer alarm system according to some embodiments.

In some embodiments (such as an embodiment shown in FIG. 11), the probe housing 140 is not triangular in cross section but rather has a back edge 155 that is higher than a front edge 156, where the back edge 155 is associated with the portion of the probe housing 140 that faces away from the normal flow of wastewater through the pipe 108. The front edge 156 is formed and shaped to provide a flow of wastewater across the surface of the probe housing 140 without causing wastewater to collect near the probes when water is flowing in the normal flow through the pipe 108. When wastewater backs up in the pipe (that is, when the flow of water is not along the normal direction of flow through the pipe), the wastewater may collect or accumulate near the back edge 155 (where the probes are exposed). In some embodiments, the probe housing 140 may further have one or more vents 157 or other features on a top surface of the housing 140 which are selected to allow air to escape from an interior of the probe housing 140. Applicant has discovered that in some situations, when air bubbles or pockets are trapped within the probe housing 140, the probes may not properly operate to detect wastewater. One or more vents 157 provide desirable results in allowing such air bubbles or pockets to be minimized or eliminated.

Pursuant to some embodiments, installation of the sewer alarm system 110 on a pipe 108 is a straightforward process. As shown in FIG. 3, the probe housing 140 is substantially circular in cross section. To install the alarm system 110, a homeowner or maintenance person simply locates a suitable section of pipe 108 and drills or bores a single hole having a diameter substantially equal to the diameter of the probe housing 140. In some embodiments, the sewer alarm system 110 is preferably mounted on a top portion of a pipe 108. That is, the sewer alarm system 110 and the probe housing 140 are located on the portion of pipe 108 that is higher than the portion of pipe through which wastewater typically flows. That is, referring to FIG. 5, the wastewater typically flows along the bottom portion of the pipe, and the sewer alarm system 110 is mounted on a top portion of the pipe 108. The probe housing 140 is then positioned proximate the hole and inserted through the pipe 108. The shaped housing 128 is positioned such that it is proximate the exterior surface of the pipe and the straps 112 are tightened to secure the alarm system 110 to the pipe. In some embodiments, as described above, a gasket may be positioned between the shaped housing 128 and the exterior surface of the pipe to provide a seal. In some embodiments, the diameter of the hole bored is approximately 1 inch.

Figure 6:
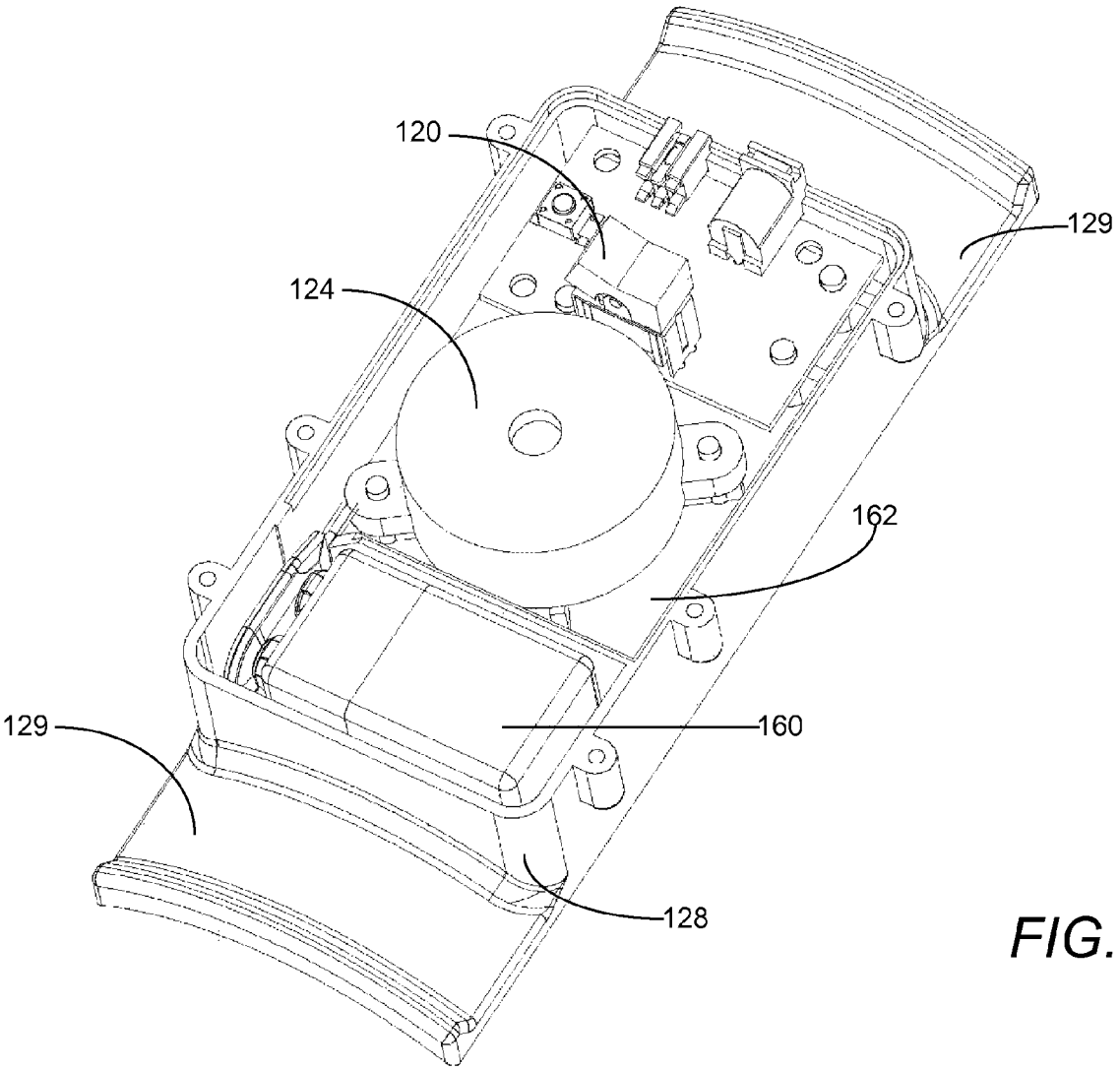
FIG. 6 is a view of a portion of the sewer alarm system according to some embodiments.

Referring now to FIG. 6, a view of the shaped housing 128 pursuant to some embodiments is provided. The shaped housing 128 may be formed with several sections, including two lips 129 which are positioned to receive straps 112 (not shown in FIG. 6, but shown in FIG. 2) such that the straps 112 firmly secure the shaped housing 128 to the pipe 108. The shaped housing 128 may also include a region for a battery 160 as well as a circuit board 162. The circuit board 162 may be formed to provide electrical connections between the battery 160 and other components, including the switch 120 and speaker 124. In some embodiments, other power sources may be provided and the battery 160 may be used as a backup power source. In some embodiments, other types of alerting devices may be used (in addition to, or instead of the speaker 124) such as, for example, a connection to an existing or other alarm system. In some embodiments, a test button or mechanism may also be used to allow a user to test or verify the operation of the alarm system 110.

Figure 7:
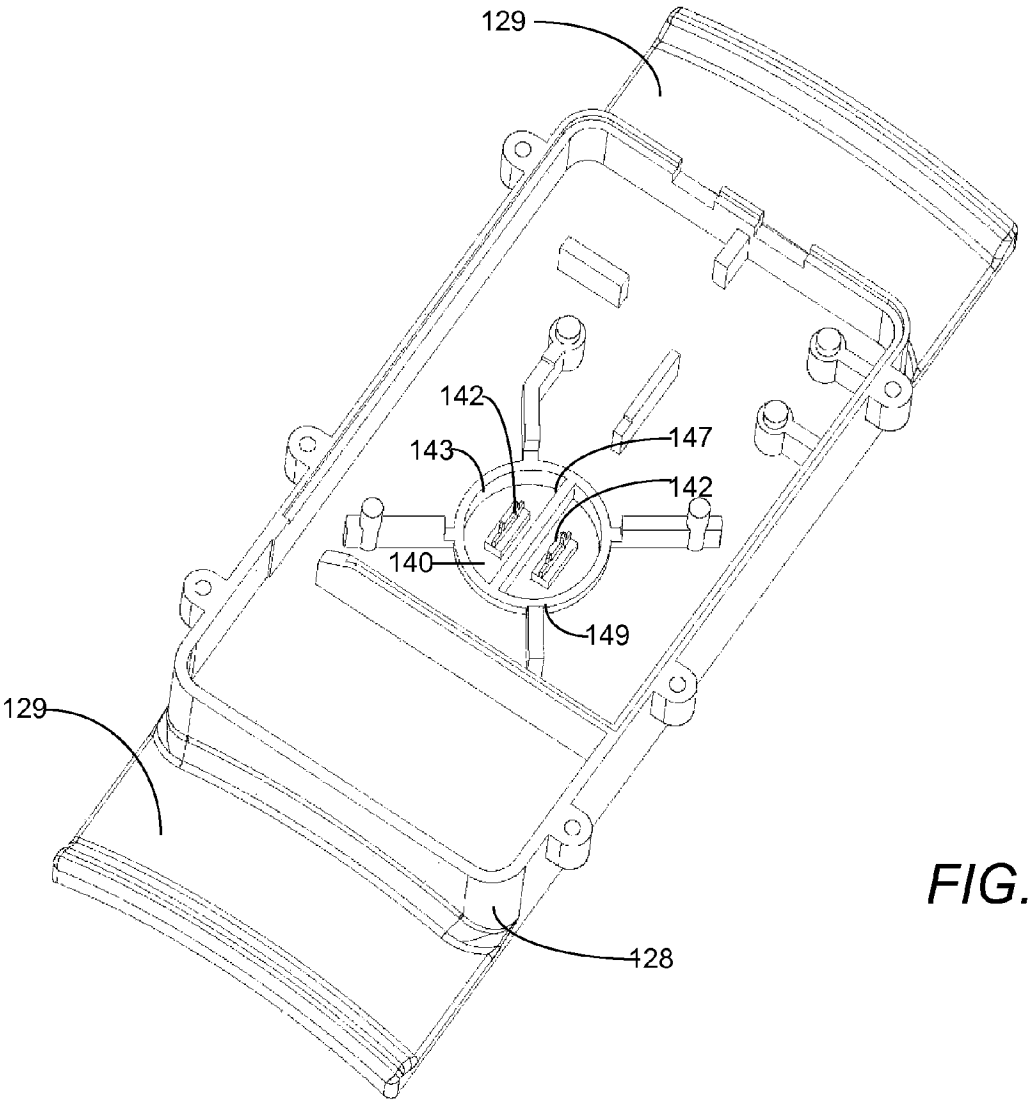
FIG. 7 is a view of a portion of the sewer alarm system according to some embodiments.

Referring now to FIG. 7, a further view of the shaped housing 128 is shown (prior to installation of the circuit board 162). In particular, the shaped housing 128 and portions of the probe housing 140 are shown. The probe housing 140 is formed in a base of the shaped housing 128 and includes a barrier 149 formed around a circumference of the probe housing 140. A divider or barrier 147 separates each probe 142 from the other and may be formed of the same material as the housing 128. In some embodiments, the recesses formed by barrier 149, 147 may be filled with a semi-liquid gasket or sealant to prevent liquid from collecting around the probes 142. For example, during a manufacturing process, the recesses formed by barrier 147, 149 may be filled with a glue or other waterproof sealant. For Electrical contacts for the probes 142 extend upward from the probe housing 140 for connection with the circuit board 162.

Figure 8:
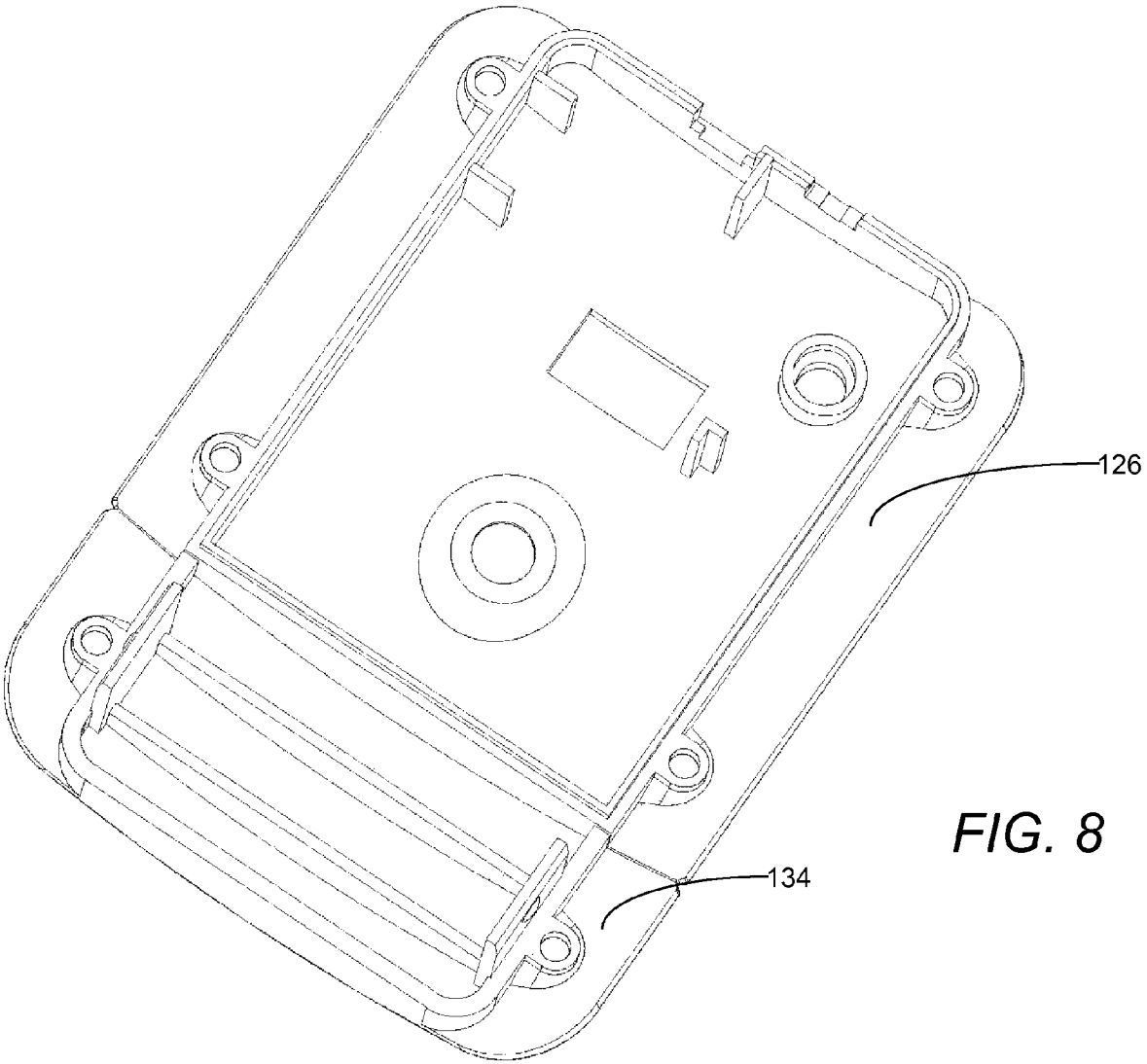
FIG. 8 is a view of a top portion of a housing of a sewer alarm system according to some embodiments.
Figure 9:
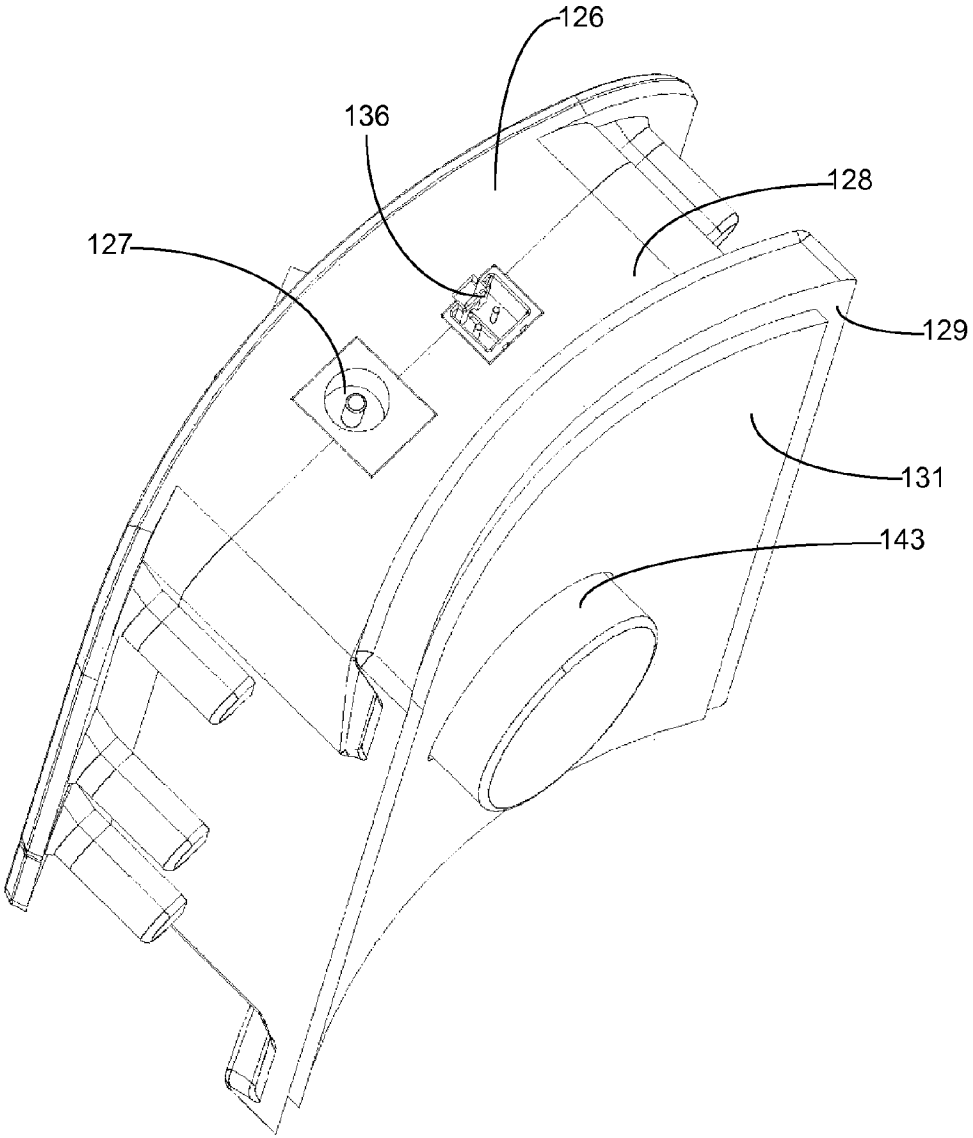
FIG. 9 is a further view of a portion of the sewer alarm system according to some embodiments.

Referring now to FIG. 8, a further view of the electronics cover 126 and the battery cover 134 are shown. Each or all of the covers may be removably attached to the shaped housing 128 (e.g., using recessed screw mounts or the like), allowing access to the battery (in the case of the battery cover 134) and the electronics and speaker (in the case of the electronics cover). Referring now to FIG. 9, a further view of the shaped housing 128 is shown in a view that shows the underside of the shaped housing 128 including the bottom surface 129 of the housing as well as the gasket 131 that sits between the bottom surface 129 and the exterior surface of a pipe (not shown in FIG. 9). The lip 143 of the probe housing is shown as extending a distance outward from the bottom surface 129. As shown, the lip is formed in a cylindrical shape and is formed to extend the probe housing a distance into a pipe as described above. In the embodiment of FIG. 9, the end of the probe housing is not shown (to allow illustration of the cylindrical shape of a portion of the housing that extends a distance into a pipe).

Figure 10:
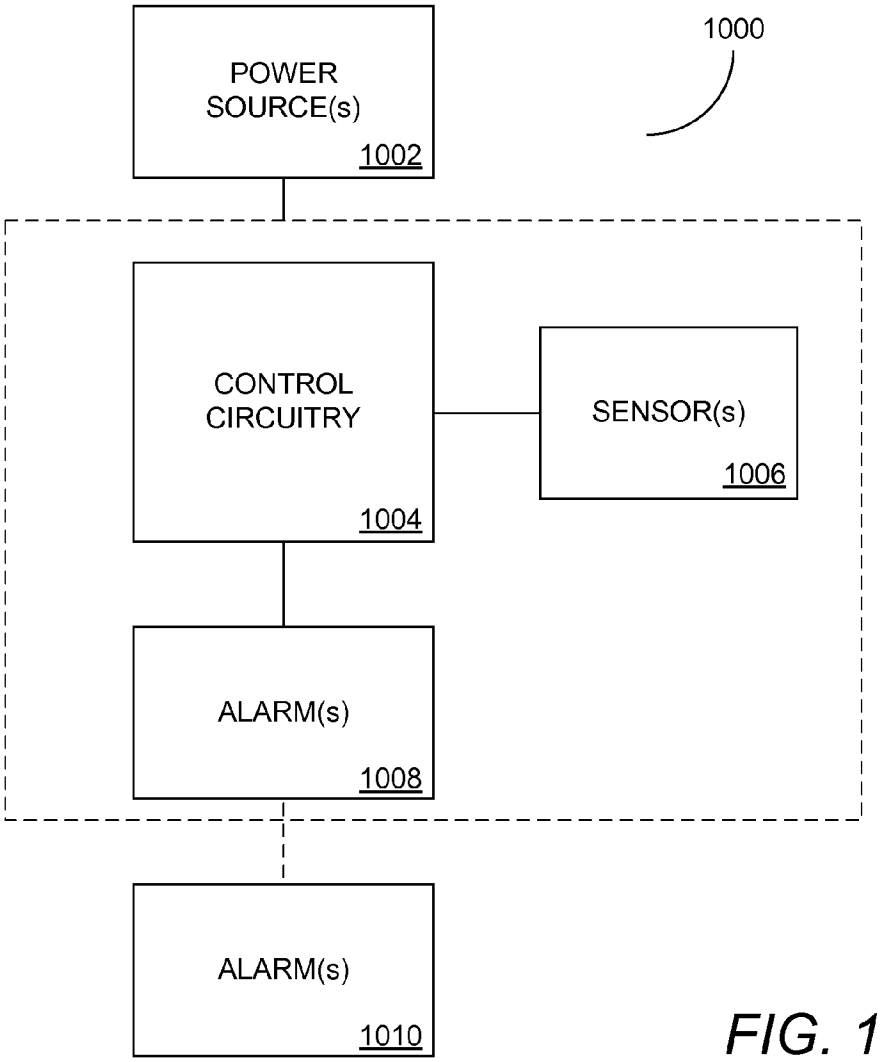
FIG. 10 is a block diagram of the electronics of a sewer alarm according to some embodiments.

Reference is now made to FIG. 10, where a block diagram 1000 is shown depicting certain components of some embodiments of the present invention. As shown, in some embodiments, the sewer alarm of the present invention includes a number of electrical components that together operate to provide an alert or alarm to a user (such as a homeowner, building owner, maintenance worker or the like) in the event of a clog or backup in a drain system. As depicted in FIG. 10, the components may include control circuitry 1004, one or more power sources 1002, one or more sensors 1006 and one or more alarms 1008. Pursuant to some embodiments, the power sources 1002 may include one or more of a battery (e.g., such as a 9 Volt battery mounted in the shaped housing 128 of the alarm system) as well as an external power source. For example, the external power source may be provided by a wall adapter plug (such as, for example, a 9 Volt DC adapter). In some embodiments, a battery may be used as a backup power source and the external power source may be used as the primary power source. The power sources 1002 supply power to the control circuitry 1004, the sensor(s) 1006 and the alarm(s) 1008. In some embodiments, some portion of the power source(s) 1002, control circuitry 1004, sensor(s) 1006 and alarm(s) 1008 may be mounted on a circuit board contained within the shaped housing 128 of the alarm system.

In one example embodiment, switching between the power sources 1002 (e.g., such as switching from the external power source and the backup power source) may be controlled using a control circuit such as the Low Loss PowerPath Controller (manufacturer's part number LTC4412ES6#PBF) offered by Linear Technologies. Other suitable circuits may also be used with desirable results.

In some embodiments, the control circuitry 1004 may include circuitry that receives data from one or more sensor(s) 1006 and that controls the operation of one or more alarm(s) 1008, 1010 to alert homeowners, building owners, maintenance personnel or the like of the presence of potentially undesirable wastewater. A number of different circuits may be used to implement the functions of control circuitry 1004. In one illustrative but not limiting example, the control circuitry 1004 may include a comparator such as, for example, an ultralow power quad comparator offered by Linear Technologies (e.g., such as manufacturer part number LTC1444IS#PBF). Other controllers, including, for example, microprocessor controllers, may also be used with desirable results.

In some embodiments, the one or more alarm (s) 1008 may include a speaker or other device which emits an audible tone when the presence of wastewater is detected by the sensor(s) 1006. For example, one suitable speaker is part number PS-562Q offered by Mallory Sonalert Products, Inc., although a wide variety of other speakers or devices may be used with similarly desirable results. In some embodiments, in addition to an audible alarm, one or more visual alarms may also be utilized (e.g., such as an LED or other light source which is enabled when the sensor(s) 1006 detect the undesirable presence of wastewater). In some embodiments, the alarm(s) 1008 may include other forms of notification. For example, in some embodiments, the alarm(s) 1008 may include one or more remote alarm(s) 1010 which are activated via remote connection such as via a WiFi, Bluetooth or other network connection which causes an alert to be transmitted to a remote recipient. For example, in some embodiments, when the undesirable presence of wastewater is detected by the sensor(s) 1006, an email, text message, or other notification may be transmitted from the alarm(s) 1008 to a remote recipient alerting the recipient of the presence of wastewater. In some embodiments, a cellular or other wireless connection may be provided to facilitate such communication.

Embodiments of a sewer alarm have been described herein in the context of identifying backups or potential backups in residential, commercial, industrial and other building applications, but it should be understood that other applications are possible. For example, embodiments may be used to detect the undesirable presence of fluids in other types of drainage systems.

The above description and/or the accompanying drawings are not meant to imply a fixed order or sequence of steps for any process referred to herein; rather any process may be performed in any order that is practicable, including but not limited to simultaneous performance of steps indicated as sequential.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. A sewer alarm, comprising:

a housing defining an interior volume, said housing mounted on an exterior surface of a pipe;

at least a first mounting portion, extending outwardly from said housing, said at least first mounting portion receiving at least a first mounting device securing said housing to said exterior surface of said pipe;

a probe housing extending from said interior volume of said housing to an interior of said pipe; and at least a first probe disposed within said probe housing and exposed to said interior of said pipe along a first direction substantially along a center axis of said pipe.

2. The sewer alarm of claim 1, further comprising: a gasket positioned between a bottom portion of said housing and said exterior surface of said pipe.

3. The sewer alarm of claim 1, wherein a bottom portion of said housing is shaped to match an exterior surface radius of said pipe.

4. The sewer alarm of claim 1, wherein said probe housing includes a top surface shaped to form a recess shielding said at least first probe from liquid during a normal flow of liquid within said pipe.

5. The sewer alarm of claim 4, wherein said recess of said probe housing is positioned to allow liquid to access said at least first probe during a non-normal flow of liquid within said pipe.

6. The sewer alarm of claim 4, further comprising: at least a second probe disposed within said probe housing, said at least first and second probes configured to detect the presence of liquid during a non-normal flow of liquid within said pipe.

7. The sewer alarm of claim 3, wherein at least a portion of said housing is removably attached to said bottom portion.

8. The sewer alarm of claim 1, further comprising: a control circuit disposed within said interior volume of said housing, said control circuit in electrical communication with said at least first probe; and an alarm, said alarm engaged when said control circuit receives a signal from said at least first probe indicating the presence of liquid during a non-normal flow of liquid within said pipe.

9. The sewer alarm of claim 8, further comprising: at least a first power source coupled to said control circuit and said alarm.

10. The sewer alarm of claim 8, further comprising: an external alarm device in wireless communication with said control circuit.

11. The sewer alarm of claim 1, wherein said probe housing is substantially cylindrical in shape and has a length selected to extend between one quarter of an inch and one inch into said interior of said pipe.

12. The sewer alarm of claim 11, wherein said alarm is installed on said pipe by boring a hole approximately equal to a diameter of said probe housing through said exterior surface of said pipe.

13. The sewer alarm of claim 1, wherein said pipe is a drain pipe in a building sewer system and the sewer alarm is positioned near a point where the drain pipe exits the building.

14. An alarm device, comprising:

a housing defining an interior volume, said housing mounted on an exterior surface of a pipe;

a first and a second mounting portion, each extending outwardly from said housing and shaped to receive a first and a second mounting device, the mounting devices securing said housing to said exterior surface of said pipe;

a probe housing extending from said interior volume of said housing to an interior of said pipe; and a first and a second probe disposed within said probe housing and exposed to said interior of said pipe along a first direction substantially along a center axis of said pipe.

* * * * *